US008186087B2

(12) United States Patent
Ogershok

(10) Patent No.: US 8,186,087 B2
(45) Date of Patent: May 29, 2012

(54) RIFLE TRIGGER SAFETY BLOCK

(75) Inventor: Daniel Ogershok, Russelton, PA (US)

(73) Assignee: Brenshok LLC, Russelton, PA (US)

( * ) Notice: Subject to any disclaimer, the term of this patent is extended or adjusted under 35 U.S.C. 154(b) by 295 days.

(21) Appl. No.: 12/574,396

(22) Filed: Oct. 6, 2009

(65) Prior Publication Data

US 2010/0083550 A1 Apr. 8, 2010

Related U.S. Application Data

(60) Provisional application No. 61/195,328, filed on Oct. 6, 2008.

(51) Int. Cl.
*F41A 17/54* (2006.01)
*F41A 17/46* (2006.01)

(52) U.S. Cl. ..... 42/70.06; 42/70.07

(58) Field of Classification Search ..... 42/70.06, 42/70.07

See application file for complete search history.

(56) References Cited

U.S. PATENT DOCUMENTS

| | | | | | |
|---|---|---|---|---|---|
| 170,988 | A | * | 12/1875 | Chillingworth | 42/70.06 |
| 2,225,583 | A | | 1/1940 | Blizard | |
| 2,458,616 | A | | 1/1949 | Maynor | |
| 3,269,046 | A | | 8/1966 | Schaefer | |
| 4,054,003 | A | | 10/1977 | Wilson | |
| 4,300,301 | A | | 11/1981 | Morrison | |
| 4,719,713 | A | * | 1/1988 | Hagle | 42/1.01 |
| 4,754,568 | A | | 7/1988 | Brandt | |
| 4,825,576 | A | * | 5/1989 | Troncoso et al. | 42/70.07 |
| 5,025,582 | A | * | 6/1991 | Mote, Sr. | 42/70.06 |
| 5,052,142 | A | | 10/1991 | Mikus | |
| 5,146,705 | A | | 9/1992 | Martin | |
| 5,214,233 | A | | 5/1993 | Weldle et al. | |
| 5,752,338 | A | | 5/1998 | Lameiras Guede | |
| 5,910,002 | A | * | 6/1999 | Hunter | 42/70.07 |
| 5,918,402 | A | | 7/1999 | Weinraub | |
| 6,018,900 | A | | 2/2000 | Guede | |
| 6,055,759 | A | * | 5/2000 | Langner | 42/70.07 |
| 6,128,847 | A | | 10/2000 | Langer | |
| 6,141,896 | A | | 11/2000 | Oberst | |

(Continued)

OTHER PUBLICATIONS

"Bolt action", http://en.wikipedia.org/wiki/Bolt_action, Jul. 10, 2008.

(Continued)

*Primary Examiner* — Bret Hayes
(74) *Attorney, Agent, or Firm* — McNees Wallace & Nurick LLC

(57) ABSTRACT

A trigger blocking device comprised of a frame removably affixed around a trigger guard of a rifle. The trigger blocking device holds a blocking shaft behind the trigger, the shaft being capable of sliding longitudinally or axially into two separate positions, one position where the shaft blocks the operation of the trigger and the other position where a recessed area in the shaft forms a trigger channel, when moved into position, allows the operation of the trigger. The blocking shaft extends across the frame and is positioned behind the trigger. When the blocking shaft is behind the trigger in a first position with the trigger channel not aligned with the trigger, the blocking shaft prevents rearward movement of the trigger, preventing the firearm from firing. When the blocking shaft is moved to a second position wherein the trigger channel is aligned with the trigger, the trigger when pulled can move rearward into the trigger channel to allow the firing mechanism of the firearm to be activated, that is, to fire.

12 Claims, 3 Drawing Sheets

U.S. PATENT DOCUMENTS

| | | | | |
|---|---|---|---|---|
| 6,401,377 | B1 | 6/2002 | Vendetti et al. | |
| 6,629,379 | B1 * | 10/2003 | Doiron | 42/70.11 |
| 6,851,213 | B1 | 2/2005 | Doiron | |
| 7,036,258 | B1 * | 5/2006 | Lee et al. | 42/70.06 |
| 7,051,467 | B1 | 5/2006 | Huber | |
| 2004/0144009 | A1 * | 7/2004 | Lee et al. | 42/70.06 |
| 2005/0188582 | A1 * | 9/2005 | Doiron et al. | 42/70.06 |

OTHER PUBLICATIONS

"Mosin-Nagant", http://en.wikipedia.org/wiki/Mosin-Nagant, Sep. 24, 2008.

"Katyusha", http://www.sff.net/people/sanders/mosin.html, Sep. 25, 2008.

* cited by examiner

RIFLE TRIGGER SAFETY BLOCK

CROSS-REFERENCES TO RELATED APPLICATIONS

This patent application claims the benefit of U.S. Provisional Patent Application No. 61/195,328, filed Oct. 6, 2008, entitled RIFLE TRIGGER SAFETY BLOCK, for which priority is claimed and the disclosure of which is hereby incorporated by reference.

FIELD OF THE INVENTION

The present invention is generally directed to a trigger blocking apparatus for a firearm, and specifically to an external trigger blocking apparatus for a rifle.

BACKGROUND OF THE INVENTION

The present invention is directed toward an external trigger blocking device to be used generally in conjunction with a bolt-action rifle and in particular, a Mosin-Nagant rifle and other firearms with similar trigger mechanisms.

The Mosin-Nagant rifle is a military rifle that was used by the armed forces of the Russian Empire, the Soviet Union and various Eastern bloc nations from 1891 until the 1960's. The rifle was particularly prevalent in World War II when the Mosin-Nagant was the standard issue weapon to the Soviet troops. It is estimated that by the end of the war, approximately 17.4 million M 91/30 Mosin-Nagant rifles had been produced. Even though production of the Mosin-Nagant rifle ceased in the 1960s, the rifle is still used in many military conflicts due to its ruggedness and widespread availability.

In recent years, the Mosin-Nagant has become a popular hunting rifle, particularly in the United States. The rifle is relatively inexpensive, very sturdy, reliable and military accurate. Readily available models include the Russian Mosin-Nagant M91/30; M38; M44 and the Finish M39, which is considered to be one of the finest and most accurate military rifles ever produced. However, the safety (or safety catch) on the Mosin-Nagant rifle is extremely hard to operate and represents a major shortcoming for its use as a hunting rifle. The safety consists of a knob at the back of the bolt which must be pulled back and turned to one side to lock the firing pin, reversing the process to release it. The safety requires a great deal of hand strength to operate and is inherently clumsy and slow which often results in the game moving on before the hunter has the chance to shoot. Thus, the user of the rifle may be tempted to leave the safety off so that the rifle is ready for immediate use, a situation that causes obvious safety concerns as the rifle may accidentally discharge.

Another example of a military rifle that has a safety that is somewhat difficult to operate is the Karabiner Model 1931, also known as the K31 or Schmidt-Ruben rifle. The K31 is a magazine-fed, straight-pull bolt action rifle that was the standard issue rifle of the Swiss armed forces from 1933 until 1958, although some remained in service into the 1970s. Although the majority of K31 rifles were used during World War II, most of the rifles which are now readily available from military surplus vendors are ones used in military training courses throughout the late 1970s. K31s are known for their amazing accuracy and quality having tight tolerances and excellent overall craftsmanship.

The safety on the K31 consists of a rather large ring on the rear of the bolt that must be pulled and rotated 45 degrees to the right to prevent the rifle from firing, yet at the same time still allow the bolt to operate normally. Rotating the ring 90 degrees to the right and dropping it into a slot will lock up the bolt solidly and prevent firing. To fire the rifle, one must pull back on the ring and rotate it to the left to allow it to return to the firing position. This again is inherently clumsy and somewhat slow which may result in the game moving on before the hunter has the chance to shoot. A temptation to leave the safety off is thus created, a situation that causes obvious safety concerns as the rifle may accidentally discharge.

As demonstrated by these two examples, there is accordingly a need for an easily operable device that can be used to block the firing of the firearm while the safety is disengaged until moments before a shot is taken.

Prior trigger safety devices known in the art have been unsatisfactory for this purpose because they were not quickly or easily operable or may be inadvertently shifted to the non-firing position. Still other trigger safety devices are fairly easy to operate but need to be internally installed or externally mounted on the firearm thus requiring costly alterations by a skilled gunsmith. Finally other prior art trigger safety devices are not suited for the type of trigger utilized in the Mosin-Nagant rifle or firearms with similar trigger mechanisms where the trigger blade is housed within the body of the rifle.

In view of the disadvantages to the devices known in the art, there is a need for a relatively simple and easily operable trigger block that can be removably affixed to the trigger guard without the need to make alterations to the firearm.

SUMMARY OF THE INVENTION

A trigger blocking device is comprised of a frame removably affixed around the trigger guard which holds a blocking shaft behind the trigger, the shaft being capable of sliding longitudinally or axially into two separate positions, one position where the shaft blocks the operation of the trigger and the other position where a recessed area in the shaft, when moved into position, allows the operation of the trigger. The blocking shaft extends across the frame and is positioned behind the trigger. When the blocking shaft is behind the trigger in a first position with the recessed area not aligned with the trigger, the blocking shaft prevents rearward movement of the trigger, preventing the firearm from firing. When the blocking shaft is moved to a second position wherein the recessed area is aligned with the trigger, the trigger when pulled can move rearward into the recessed area to allow the firing mechanism of the firearm to be activated, that is, to fire.

A first object of the invention is to provide for a simple, relatively inexpensive and easily manufacturable device to block the operation of the trigger while the safety is disengaged until moments before the firearm is fired.

Another object of the invention is to provide for a trigger block that is externally attachable to and removable from the trigger guard and does not require any alteration to the firearm. The trigger block is also easily attachable and removable from the trigger guard using standard tools.

Another object of the invention is to provide for a trigger block that is externally attachable to and removable from the trigger guard that is easily adjustable to accommodate varying dimensions of the trigger guard itself.

Another object of the invention is to provide a trigger block that is easy to operate so as not to preclude quick firing of the firearm when the target moves into sight.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
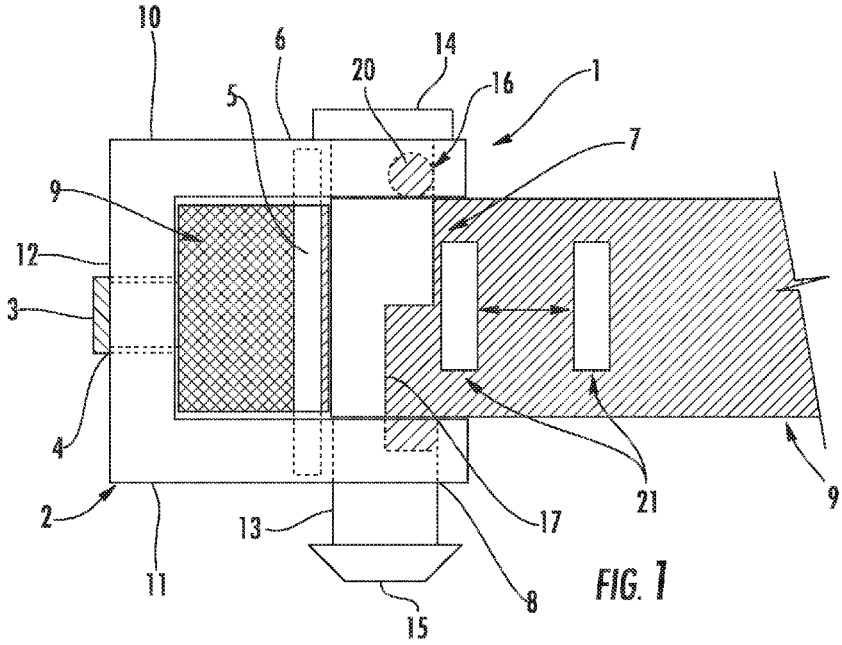
FIG. 1 is a sectional bottom plan view of the trigger block in the on or "no fire" position affixed to the trigger guard with a portion of the three-sided frame of the trigger block cut away to show the operation of the blocking pin of the trigger guard, which is lying on the top inner surface of the trigger guard.

With reference to the drawings, wherein like numerals represent like parts throughout the figures, a trigger safety block in accordance with the present invention is generally designated by numeral 1. A representative trigger safety block in accordance with the present invention is illustrated in FIGS. 1-5. The trigger safety block 1 is comprised of a frame 2, a set screw 3, a set screw bore hole 4, a retaining pin 5, a retaining pin bore hole 6, a blocking pin 7 and a blocking pin bore hole 8.

Frame 2 in this preferred embodiment is three-sided and fits around the exterior back and side surfaces of the distal end of trigger guard 9. The first frame side 10 and an opposed third frame side 11 have a corresponding blocking pin bore hole 8 and at least one retaining pin bore hole 6, also shown in FIG. 3A. In this preferred embodiment, there are at least two corresponding retaining pin bore holes 6 in the first frame side 10 and third frame side 11 which are located adjacent to the blocking pin bore hole 8 but closer to the second frame side 12. In other preferred embodiments, additional corresponding sets of retaining pin bore holes 6 may be added to provide adjustment for varying thicknesses of the distal end of trigger guard 9, and to allow blocking shaft to abut the trigger, if not contact the trigger. In this preferred embodiment, the first and second retaining pins 5 are comprised of high-carbon or "spring steel" or another rigid material having some inherent flexibility. The middle or second frame side 12 has a threaded set screw bore hole 4 to receive set screw 3. Frame 2 is open opposite middle or second frame side 12 so that trigger safety block 1 can be assembled around an exterior back and side surfaces of a distal end of the trigger guard.

The blocking pin 7 is comprised of an elongated blocking shaft 13, having a fixed end cap 14 on its first end, a removable end cap 15 on its second end, a detent member 16 and a trigger channel 17, although other mechanical devices may be used to secure the blocking pin 7 within the blocking pin bore holes. In the preferred embodiment. the removable end cap 15 is affixed to the blocking shaft 13 by a fastener, which in this preferred embodiment is comprised of a threaded shaft 18 extending from the removable end cap 15, see FIG. 4, which is secured to the blocking shaft 13 by screwing the threaded shaft 18 into a tapped bore hole 19 (shown in Picture 1) in the second end of blocking shaft 13. Both fixed end cap 14 and the removable end cap 15 have an exterior rim dimension greater than the outer dimension of the blocking pin bore hole 8 to retain blocking pin 7 in blocking pin bore hole 8. The length of the blocking shaft 13 is longer than the length of the second frame side 12 so that the blocking pin 7 may be reciprocated in a longitudinal direction into separate on and off positions by applying force to either the fixed end cap 14 or the removable end cap 15 as the case may be. A detent member 16 is located on the blocking shaft 13 preferably proximal to the fixed end cap 14, although detent member may be located proximate to removable end cap 15. In this preferred embodiment, the detent member 16 is comprised of a detent ball 20 fitted in a detent bore hole in the blocking shaft 13 with a detent force member behind the detent ball 20 such as a detent spring or resilient rubber as is known in the art. Other suitable detent members are also known in the art. The trigger channel 17 is located on the blocking shaft 13 proximal to the removable end cap 15 opposite detent ball 20. The trigger channel 17 is comprised of a depressed or recessed area in the blocking shaft 13 which will allow the free rearward movement of the trigger blade 21 when the blocking pin 7 is positioned in the off or "fire position".

The trigger safety block 1 is operated by first sliding frame 2 around the exterior back and side surfaces of the distal end of trigger guard 9. The first and second retaining pins 5 are then inserted in the retaining pin bore holes 6 and the set screw 3 is then tightened to hold the trigger safety block 1 in place on the trigger guard 9. As the set screw 3 is tightened, the retaining pins 5 function to provide spring tension to lock and secure the safety trigger block 1 to the trigger guard 9. Other suitable methods for securing the trigger safety block 1 to the trigger guard 9 are also known in the art. The reversible left or right blocking shaft 13 is then inserted into the blocking pin bore holes 8 with the removable end cap 15 being secured to the blocking shaft 13 and facing either exterior side of the trigger guard 9 as may be the preference of the operator as either a right or left-handed shooter. The blocking pin 7 is then positioned so that the fixed end cap 14 is lying flush on either the first frame side 10 or third frame side 11 and the removable end cap 15 is extended away from the adjacent frame side. The set screw 3 may be readjusted if necessary.

Figure 2:
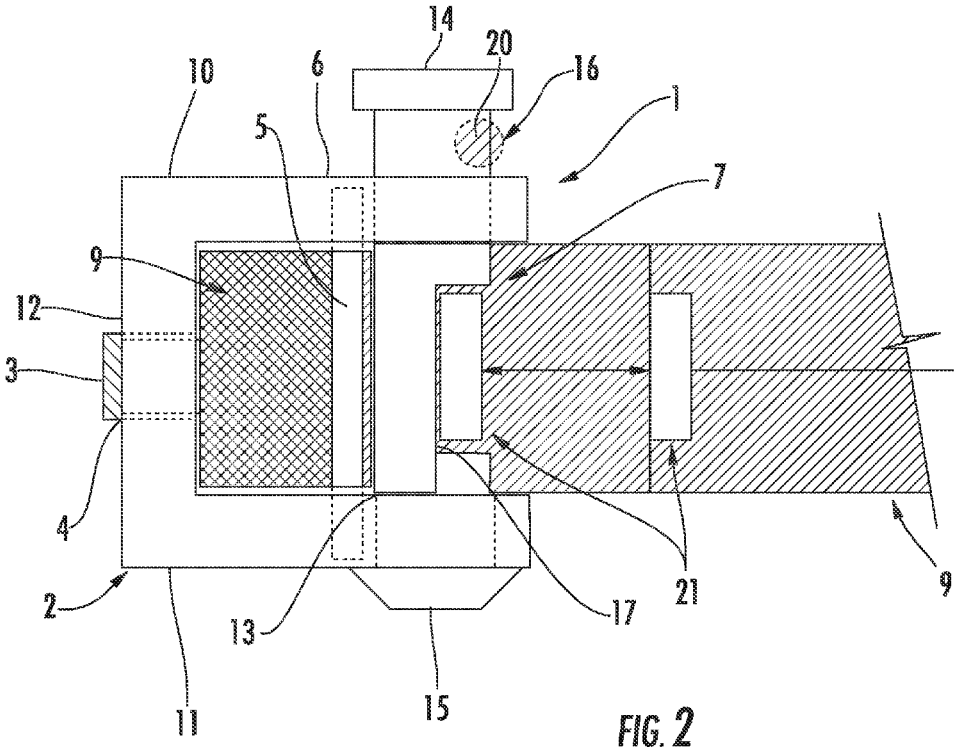
FIG. 2 is a sectional bottom plan view of the trigger block in the off or "fire" position affixed to the trigger guard with a portion of the three-sided frame of the trigger block cut away to show the operation of the blocking pin of the trigger guard, which is lying on the top inner surface of the trigger guard.
Figure 3A:
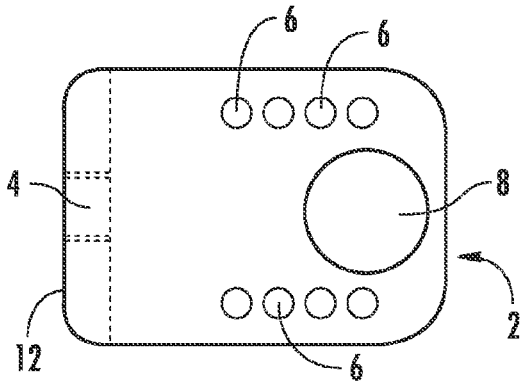
FIG. 3A is a side-elevation view of the three-sided frame member of the trigger block.
Figure 3C:
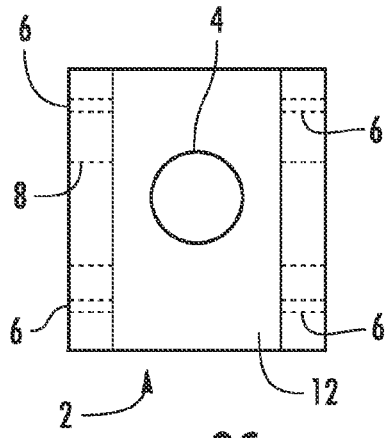
FIG. 3C is a rear elevation view of the three-sided frame member of the trigger block.
Figure 3B:
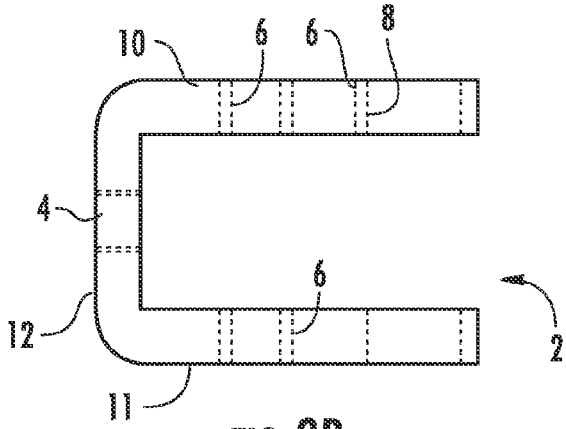
FIG. 3B is a top elevation view of the three-sided frame member of the trigger block.
Figure 4:
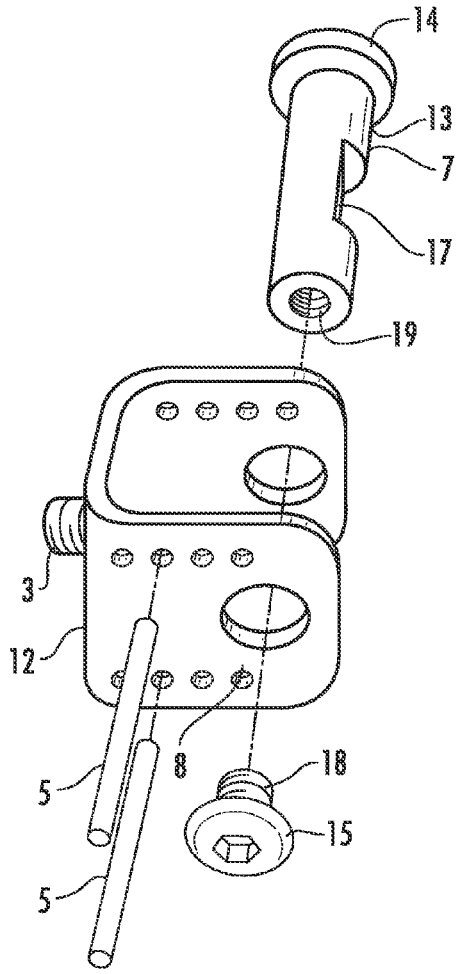
FIG. 4 is a side elevation view of the disassembled components of the trigger block.
Figure 5A:
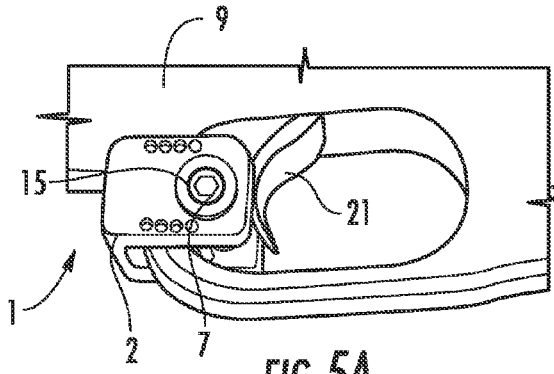
FIG. 5A is a ventral and right side elevation view of the trigger block affixed to the rear portion of a trigger guard.
Figure 5B:
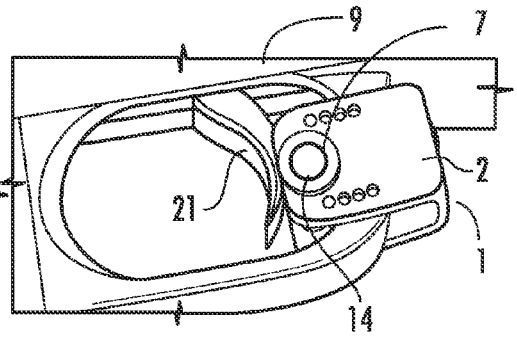
FIG. 5B is a ventral and right side elevation view of the trigger block affixed to the rear portion of a trigger guard.

As depicted in FIG. 1, when the fixed end cap 14 is lying flush on either the first frame side 10 or the third frame side 11, the trigger safety block 1 is in the on or "no fire" position as the trigger channel or recess 17 is not aligned with the trigger blade 21 and thus the blocking shaft 13 prevents the trigger blade 21 from being pulled back to discharge the firearm. When the operator wishes to discharge the firearm, the operator must apply force to an end of the blocking shaft 13, preferably the removable end cap 15, to push it towards the adjacent exterior surface of the trigger guard 9, as depicted in FIG. 2. In the preferred embodiment, when the removable end cap 15 is lying flush on either the first frame side 10 or the third frame side 11, the trigger channel 17 is aligned with the trigger blade 21 and thus the trigger may be pulled back to fire the gun. The recessed area or trigger channel 17 in the blocking shaft 13 preferably does not extend completely around blocking shaft 13 so that blocking shaft, even when moved axially to be in the firing position, may act as a complete blocking mechanism when trigger channel 17 is rotated so that it does not face the trigger. Trigger channel can be placed in this position by rotating blocking shaft at least 60°, preferably 90°, and most preferably 180° from a position in which trigger channel is perfectly aligned with the trigger. At 180°, trigger channel 17 faces directly opposite the trigger and in the direction of second frame side 12. The detent member 16 operates to hold the blocking pin 7 in either the off or on position until force is applied to either the fixed end cap 14 or the removable end cap 15 to move the blocking pin 7 from one position to the other. When trigger safety block 1 is in the "on" or "no fire" position, detent member 16 is fully outside blocking pin bore hole 8 in first frame side 10. In this position, blocking pin 7 may rotate about its axis, but cannot move axially without application of force. When trigger safety block one is moved to the "off" or "fire" position, blocking pin 7 must first be rotated so that trigger channel 17 is aligned with trigger blade. Then, force is applied to move blocking pin 7 to the position shown in FIG. 4. Detent member 16 is partially inside first frame side 10 and blocking pin bore hole 8. Once in this position, blocking pin 7 can no longer be rotated axially. When trigger blade is pulled rearward, the weapon will be fired as trigger blade is no longer blocked by blocking pin 7, and moves into trigger channel 17.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A trigger safety block movable from a first axial position in which rearward movement of a trigger within a trigger guard of a firearm to fire the firearm is prevented, to a second axial position in which movement of a trigger of a firearm to fire the firearm is enabled, comprising:

a three sided frame removably affixed around the trigger guard, the frame comprising a first frame side, an opposed second frame side and a rear frame side, wherein the three sided frame has an opening opposite the rear frame side so that the trigger safety block fits around an exterior back and side surfaces of a distal end of the trigger guard;

a blocking pin movable axially from a first position to a second position and extending across the frame between the trigger guard and the trigger;

a trigger channel in the blocking pin;

wherein the trigger channel is not aligned with the trigger when the blocking pin is in the first position so that the blocking pin prevents rearward movement of the trigger to prevent the firearm from firing; and wherein the trigger channel is aligned with the trigger when the blocking pin is in the second position so that the trigger moves rearward to enable firing of the firearm;

the first frame side and the opposed second frame side further comprising a blocking pin bore hole, the blocking pin extending across the frame and into the blocking pin bore holes in the first frame side and the opposed second frame side; and a retaining pin, wherein the first frame side and the opposed second frame side further include a plurality of retaining pin bore holes located adjacent the blocking in bore holes and between the blocking pin bore holes and the rear frame side, the retaining pin bore holes accepting the retaining pin extending across the frame and into the retaining pin bore holes in the first frame side and the opposed second frame side, the retaining pins and retaining pin bore holes enabling the trigger safety block assembly to be adjusted with respect to the distal end of the trigger guard and the trigger.

2. The trigger safety block of claim 1, further comprising a set screw and a set screw bore in the rear frame side to receive the set screw, the set screw providing tension to hold retaining pin in position and secure the trigger safety block to the trigger guard.

3. The trigger safety block of claim 1 wherein the blocking pin includes a blocking pin shaft extending through the blocking pin bore holes in the first frame side and opposed second frame side, the blocking pin shaft including a locking device at each end of opposed ends to maintain the blocking pin within the blocking pin bore holes, the length of the blocking shaft being longer than the distance between first side frame and opposed second side frame so that blocking pin can be reciprocated axially from the first position to the second position.

4. The trigger safety block of claim 3 wherein the locking device includes a fixed end cap attached to a first end of the blocking pin shaft, the fixed end cap having an exterior rim dimension greater than the diameter of the adjacent blocking pin bore hole.

5. The trigger safety block of claim 4 wherein the locking device further includes a removable end cap attached to the second opposed end of the blocking pin shaft, the removable end cap having an exterior rim dimension greater than the diameter of the adjacent blocking pin bore hole.

6. The trigger safety block of claim 5 wherein the removable end cap further includes a threaded shaft and the blocking pin-shaft includes a tapped bore hole, wherein the tapped bore hole receives the threaded shaft after blocking pin shaft is inserted through the blocking pin bore holes in the first frame side and the opposed second frame side, thereby securing the second end of the blocking pin shaft to the frame and behind the trigger.

7. The trigger safety block of claim 3 further including a detent member on the blocking pin shaft, wherein the detent member maintains the blocking pin in the first position in which the trigger channel not aligned with the trigger or in the second position in which the trigger channel is aligned with the trigger, the blocking pin shaft movable from the first position to the second position by application of force to the blocking pin.

8. The trigger safety block assembly of claim 7 wherein when the blocking pin is in the first position by application of force to move the blocking pin shaft fully in a first axial direction such that the trigger channel is not aligned with the trigger, the detent member being fully outside of the blocking pin bore hole, and the blocking pin shaft can be rotated about its axis.

9. The trigger safety block assembly of claim 8 wherein the blocking pin is in the second position by application of force to move blocking pin shaft fully in a second, opposite axial direction such that the trigger channel is aligned with the trigger, detent member being partially inside of the blocking pin bore hole and partially inside the frame, and blocking pin cannot be rotated axially.

10. The trigger safety block of claim 3 wherein the detent member further comprises a detent ball inserted in a detent bore hole in the blocking pin shaft, the detent member further including a force member behind the detent ball.

11. The trigger safety block assembly of claim 3 wherein the trigger channel does not extend completely around the blocking pin shaft so that the blocking pin shaft acts as a complete blocking mechanism when the trigger channel in the second position is rotated so that the trigger channel does not face the trigger.

12. A trigger safety block movable from a first axial position in which rearward movement of a trigger within a trigger guard of a Mosin-Nagant rifle to fire the rifle is prevented, to a second axial position in which movement of a trigger of Mosin-Nagant rifle to fire the rifle is enabled, comprising:

a three sided frame removably affixed around the trigger guard of the Mosin-Nagant rifle, the trigger guard having a first frame side, a second opposed frame side, and a rear frame side, wherein the three sided frame has an opening opposite the rear frame side so that the trigger safety block fits around an exterior back and side surfaces of a distal end of the trigger guard of the Mosin-Nagant rifle;

a blocking shaft movable axially from a first position to a second position and extending across the frame between the trigger guard and the trigger;

a trigger channel in the blocking shaft;

a blocking pin bore hole in the first frame side and the opposed second frame side; the blocking pin extending across the frame, into and through the blocking pin bore holes in the first frame side and the opposed second frame side;

a pair of retaining pins;

four retaining pin bore holes in the first frame side and the opposed second frame side, the four retaining pin bore holes located adjacent the blocking pin bore holes and between the blocking pin bore holes and the rear frame side, the retaining pin bore holes accepting the retaining pins extending across the frame and into the retaining pin bore holes in the first frame side and the opposed second frame side, the retaining pins enabling the trigger safety block assembly to be adjusted with respect to the distal end of the trigger guard and the trigger of the Mosin-Nagant rifle;

a set screw bore in the rear frame side;

a set screw received by the set screw bore, the set screw providing tension to hold the retaining pins in position to secure the trigger safety block to the trigger guard of the Mosin-Nagant rifle;

a detent member further comprising a ball inserted in a detent bore hole in the blocking shaft, the detent member further including a force member behind the detent ball, wherein the detent member maintains the blocking pin in the first axial position in which the trigger is not aligned with the trigger channel, and the blocking shaft is in the first position by application of force to move the blocking shaft in a first axial direction such that the trigger channel is not aligned with the trigger, detent member is fully outside of blocking pin bore hole and the blocking shaft can be rotated about its axis, or in the second axial position in which the trigger is aligned with the trigger channel, the blocking shaft movable from the first position to the second position by application of force to move the blocking shaft fully in a second, opposite axial direction, such that the trigger channel is aligned with the trigger, detent member is partially inside of blocking pin bore hole and partially inside the frame, and blocking pin cannot be rotated axially;

wherein the trigger channel is not aligned with the trigger when the blocking shaft is in the first position so that the blocking shaft prevents rearward movement of the trigger to prevent the firearm from firing; and wherein the trigger channel is aligned with the trigger when the blocking shaft is in the second position so that the trigger moves rearward to enable firing of the firearm.

* * * * *